US006553720B2

(12) United States Patent
Merlet

(10) Patent No.: US 6,553,720 B2
(45) Date of Patent: Apr. 29, 2003

(54) WINDOW REGULATOR HAVING A SLIDER WITH SILENT DISPLACEMENT

(75) Inventor: Sophie Merlet, Chateauneuf-sur-Loire (FR)

(73) Assignee: Meritor Light Vehicle Systems-France, Sully-sur-Loire (FR)

( * ) Notice: Subject to any disclaimer, the term of this patent is extended or adjusted under 35 U.S.C. 154(b) by 0 days.

(21) Appl. No.: 09/898,716

(22) Filed: Jul. 3, 2001

(65) Prior Publication Data

US 2002/0014039 A1 Feb. 7, 2002

(30) Foreign Application Priority Data

Jul. 4, 2000 (FR) ..... 00 08666

(51) Int. Cl.[7] ..... E05D 15/16; E06B 7/16
(52) U.S. Cl. ..... 49/440; 49/441
(58) Field of Search ..... 49/420, 424, 425, 49/428, 352, 349, 348, 376, 377, 440, 441

(56) References Cited

U.S. PATENT DOCUMENTS 4,823,511 A * 4/1989 Herliczek et al. ..... 49/404
4,875,307 A * 10/1989 Barbero ..... 49/374
4,970,828 A * 11/1990 Mesnel et al. ..... 49/374
5,505,022 A * 4/1996 Shibata et al. ..... 49/352
5,613,325 A * 3/1997 Mariel ..... 49/404
5,970,658 A 10/1999 Smith
6,115,966 A * 9/2000 Shibata ..... 49/352
6,141,910 A * 11/2000 Kobrehel et al. ..... 49/378
6,161,337 A * 12/2000 Morando ..... 49/352

FOREIGN PATENT DOCUMENTS

| | | |
|---|---|---|
| DE | 19506226 A | 8/1995 |
| EP | 997600 A1 | 5/2000 |
| WO | WO 00/21766 | 4/2000 |

* cited by examiner

*Primary Examiner*—Alvin Chin-Shue
(74) *Attorney, Agent, or Firm*—Carlson, Gaskey & Olds

(57) ABSTRACT

This invention relates to a window regulator comprising a guide rail having a slideway of L-section and a window-bearing slider in which is made a notch adapted to allow fit of the slideway. The notch is defined by walls of which zones are in sliding abutment on the adjacent guiding faces of the slideway. The zones of abutment of the slider are formed by regular surfaces with generatrix parallel to the direction of displacement of the slider.

15 Claims, 2 Drawing Sheets

WINDOW REGULATOR HAVING A SLIDER WITH SILENT DISPLACEMENT

This invention claims priority to the French Patent application serial number N 0008666 filed on Jul. 4, 2000.

FIELD OF THE INVENTION

The present invention relates to a window regulator for vehicle, comprising a guide rail presenting a slideway, a window-bearing slider in which is made a notch corresponding to the section of the slideway, to allow fit of said slideway and guiding of the slider in a direction parallel to the slideway, said notch being defined by walls of which the zones are in sliding abutment on the adjacent guiding faces of the slideway.

BACKGROUND OF THE INVENTION

At the present time, the zones of abutment of the slider are constituted by planar surfaces in contact with the faces of the slideway. In order to promote slide, the faces of the slideway may be coated with grease or coated with a layer of an appropriate material having a low coefficient of friction with the material constituting the slider.

These arrangements give good results. However, it has been observed that the displacement of the slider along the rail causes noises, particularly in the case of vibration of the vehicle.

A more thorough study of the phenomenon revealed that such noises occur when there are specks of dust on the slideway. Now, it is inevitable that, in the long run, dust is deposited on the slideways.

WO 00 21766 relates to a window regulator having two guide rails bearing the window. In order to compensate the errors of parallelism between the two guide rails, one of the sliders is provided to be able to move in the longitudinal direction of the vehicle with respect to its guide rail. To that end, one flange of this guide rail, located in a longitudinal vertical plane, is inserted with a longitudinal clearance between two curvilinear walls of a notch made in this slider. This arrangement allows this slider to be guided in a longitudinal vertical plane, but does not allow guiding of this slider in a direction parallel to the slideway. It is therefore a "slave" slider, illustrated in FIG. 3 of this document, by opposition to a "master" slider, illustrated in FIG. 1 and forming the subject matter of the present invention.

It is an object of the present invention to eliminate the noises caused by the slider sliding along the slideway, even if the latter is covered with specks of dust.

SUMMARY OF THE INVENTION

The invention attains its object in that the zones of abutment of the slider are formed by regular convex surfaces with generatrix parallel to the direction of displacement of the slider.

Thus, thanks to the invention, the useful guiding surfaces are clearly reduced with respect to the state of the art.

The slider preferably presents only one zone of abutment opposite each guide wall of the slideway.

The slider is advantageously made of synthetic material and preferably polyoxymethylene.

The faces of the slideway are advantageously coated with a film of a material presenting a low coefficient of friction.

BRIEF DESCRIPTION OF THE DRAWINGS

The invention will be more readily understood on reading the following description given by way of example, with reference to the accompanying drawings, in which.

DESCRIPTION OF PREFERRED EMBODIMENT

Figure 1:
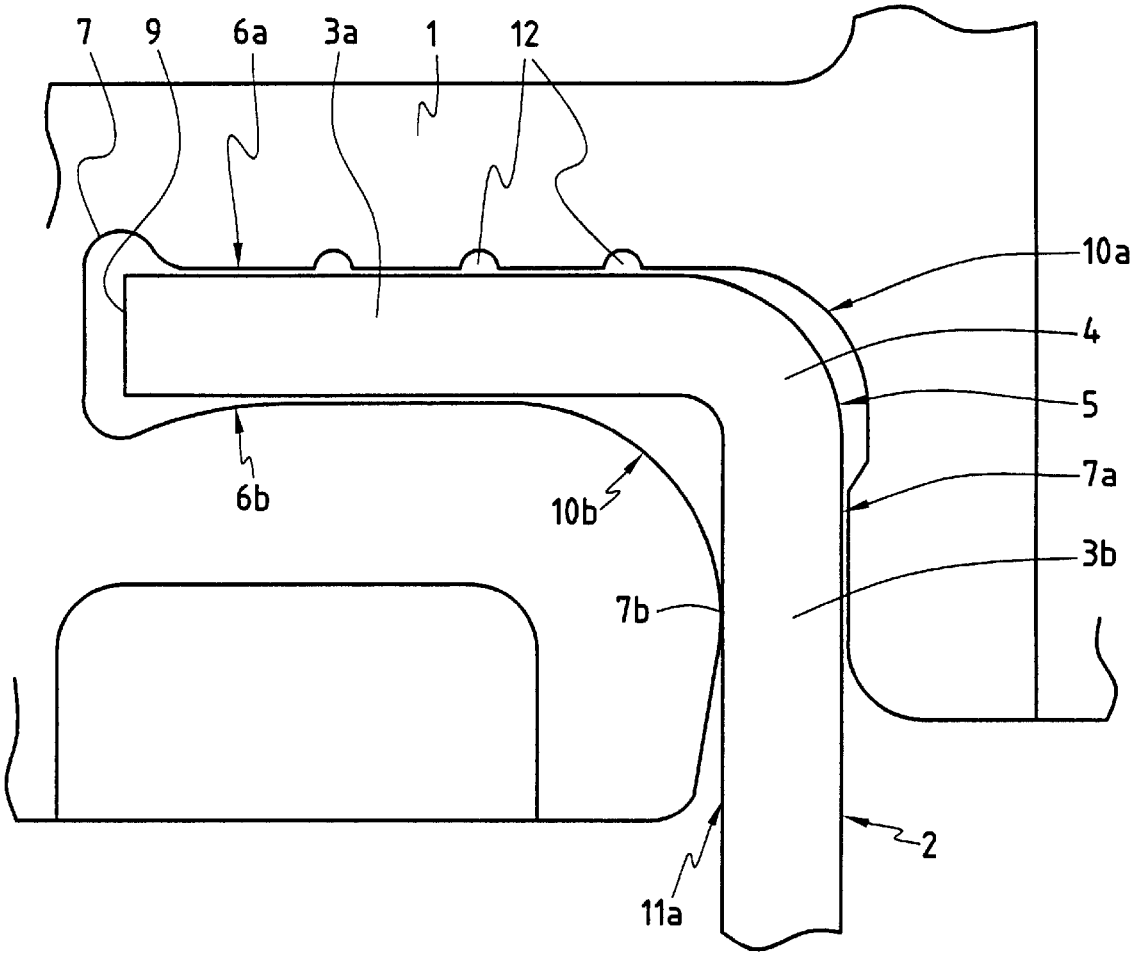
FIG.1 PRIOR ART
FIG. 1 shows in section along a transverse plane a slideway of a window regulator rail and the configuration of the notch of the slider of the prior art mounted to slide on the slideway.

Referring to prior art FIG. 1, a slider 1 presents a notch 5, substantially of an L-section, corresponding to the section of the slideway 2, so that it can be fitted on said slideway 2. The notch 5 is defined by two first opposite walls 6*a* and 6*b* between which is disposed the flange 3*a* of the slideway 2 and two second opposite walls 7*a* and 7*b*, between which is disposed the flange 3*b* of the slideway 2. The two first opposite walls 6*a* and 6*b* are joined by a notch bottom 7 located at a distance from the free face of the flange 3*a* in order to avoid jammings in this zone. Similarly, walls 6*a* and 7*a* of the notch 5 located on the same side of the slideway 2 are joined by a first curved section 10*a* and the other two walls 6*b* and 7*b* are joined by a second curved section 10*b*. The curved sections 10*a* and 10*b* are located at a certain distance from the bend 4 in order to avoid jammings in this zone and take into account the manufacturing tolerances of the slideway 2 and of the slider 1

The walls 6*a*, 6*b* and 7*a* present planar surfaces of broad extent in sliding abutment on the adjacent guiding faces of the flanges 3*a* and 3*b* of the slideway 2. On the contrary, wall 7*b* presents a convex surface in the vicinity of the inner wall 11*a* of the flange 3*b*. Contact in this zone is virtually limited to a generatrix of this wall 7*b* parallel to the direction of slide of the slider 1 on the slideway 2. The wall 6*a* further comprises a plurality of grooves 12 which extend parallel to the direction of slide of the slider 1 and which are intended to avoid the slider 1 jamming and to facilitate the transfer of the grease possibly deposited on the flange 3*a*.

The slider 1 is made of a synthetic material, preferably polyoxymethylene, and presents a notch 5, substantially of L-section, corresponding to the section of the slideway 2, so that it can be fitted on said slideway 2.

The notch 5 is defined by two first opposite walls 6*a* and 6*b* between which is disposed the flange 3*a* of the slideway 2 and two second opposite walls 7*a* and 7*b*, between which is disposed the flange 3*b* of the slideway 2. The two first opposite walls 6*a* and 6*b* are joined by a notch bottom 7 located at a distance from the free face of the flange 3*a* in order to avoid jammings in this zone. Similarly, walls 6*a* and 7*a* of the notch 5 located on the same side of the slideway 2 are joined by a first curved section 10*a* and the other two walls 6*b* and 7*b* are joined by a second curved section 10*b*. The curved sections 10*a* and 10*b* are located at a certain distance from the bend 4 in order to avoid jammings in this zone and take into account the manufacturing tolerances of the slideway 2 and of the slider 1.

The walls 6*a*, 6*b* and 7*a* present convex surfaces in sliding abutment with the adjacent guiding faces of the flanges 3*a* and 3*b* of the slideway 2. The wall 7*b* presents a convex surface in the vicinity of inner wall 11*a* of the flange 3*b*.

Figure 2:
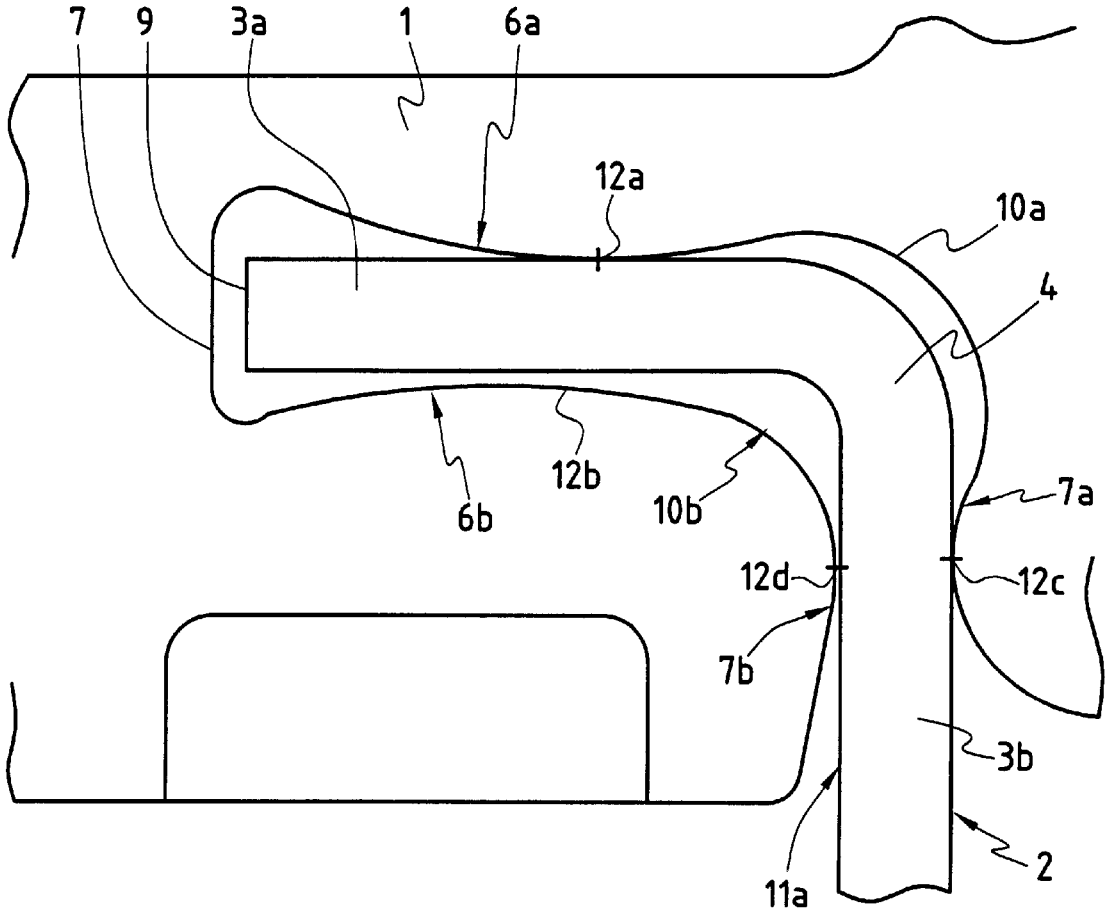
FIG. 2 is similar to FIG. 1 and shows the configuration of the notch of the slider according to the invention mounted to slide on a window regulator rail slideway.

FIG. 2 shows the profile of the notch 5 according to the invention. As is seen, the four walls 6*a*, 6*b*, 7*a* and 7*b* are in the form of a regular convex surface with generatrix parallel to the direction of slide of the slider 1 along the slideway 2.

The zones of abutment of these walls 6*a*, 6*b*, 7*a* and 7*b* on the opposite faces of the flanges 3*a* and 3*b* of the slideway 2 are thus limited to four parallel generatrices which intersect the plane of FIG. 2 respectively at the reference points 12*a*, 12*b*, 12*c* and 12*d*, or to narrow bands in the vicinity of these generatrices.

Functional clearances are provided at the level of the zones of abutment in order to avoid jammings during functioning.

The surfaces of the slideway 2 may be coated with a film of a material presenting a low coefficient of friction, such as epoxy or the product sold by SOLLAC under the name Solready.

Dust endurance tests were made with a window regulator equipped with a slider according to the invention under the conditions described hereinafter. The window regulator is fixed at 30° with respect to the vertical position on an endurance plate. The loads are 90 N upward and 0 N downward. The effort blocked in stops is maintained for 0.5 second and the rest times are 20 seconds at −20° C. and +23° C. and 50 seconds at +80° C.

The window regulator must effect the following steps three times:

2000 cycles at +80° C. and 95% humidity

Addition of Arizona dust on the rail 2000 cycles at ambient temperature 1000 cycles at −20° C.

It has been noted that no noise due to the slide of the slider on the slideway was produced during these three steps.

The foregoing description is exemplary and not just a material specification. The invention has been described in an illustrative manner, and should be understood that the terminology used is intended to be in the nature of words of description rather than of limitation. Many modifications and variations of the present invention are possible in light of the above teachings. The preferred embodiments of this invention have been disclosed, however, one of ordinary skill in the art would recognize that certain modifications are within the scope of this invention. It is understood that within the scope of the appended claims, the invention may be practiced otherwise than as specifically described. For that reason the following claims should be studied to determine the true scope and content of this invention.

What is claimed is:

1. Window regulator for vehicle, comprising;

a guide rail having a slideway, a window-bearing slider in which is made a notch adapted to a section of the slideway to allow fit of the slideway and guiding of the slider in a direction parallel to the slideway, the notch being defined by walls of which zones are in sliding abutment on the adjacent guiding faces of the slideway, wherein the zones of abutment of the slider are point contacts formed by regular convex surfaces disposed on either side of said slider with generatrix parallel to the direction of displacement of the slider.

2. The window regulator of claim 1, wherein the slider presents only one zone of abutment opposite each guide wall of the slideway.

3. The window regulator of claim 1, wherein the slider is made of a synthetic material.

4. The window regulator of claim 3, wherein the slider is made of polyoxymethylene.

5. The window regulator of claim 1, wherein the faces of the slideway are coated with a film of a material presenting a low coefficient of friction.

6. The window regulator of claim 1, wherein the slideway presents an L-section.

7. The window regulator of claim 1, wherein four convex surfaces form said zones of abutment of said slider.

8. The window regulator of claim 7, wherein each of said convex surfaces defines a point contact with said slider.

9. The window regulator of claim 1, wherein said slider includes a bend section and said zones of abutment are spaced apart from said bend.

10. The window regulator of claim 1, wherein said zones of abutment are disposed on opposing convex surfaces of said slideway.

11. The window regulator of claim 1, wherein said slider includes first and second flanges each having inner and outer surfaces, said zones of abutment contact both said inner and outer surfaces of at least one of said first and second flanges.

12. The window regulator of claim 11, wherein one of said zones of abutment contact inner and outer surfaces of said second flange.

13. Window regulator for vehicle, comprising;

a guide rail having a slideway, a window-bearing slider in which is made a notch adapted to a section of the slideway to allow fit of the slideway and guiding of the slider in a direction parallel to the slideway, the notch being defined by walls of which zones are in sliding abutment on the adjacent guiding faces of the slideway, wherein the zones of abutment of the slider are formed by non-linear surfaces defining single points of contact between said slider and said slideway.

14. The window regulator of claim 13, wherein said non-linear surfaces define a convex shape.

15. The window regulator of claim 13, wherein said slider includes first and second flanges and both an inner and outer surface of one of said flanges is in point contact with said zones of abutment of said slideway.

* * * * *